United States Patent [19]

Wake

[11] 4,121,979

[45] Oct. 24, 1978

[54] METAL TREATMENT

[75] Inventor: Simon John Wake, s'Hertogenbosch, Netherlands

[73] Assignee: Oxy Metal Industries Corporation, Warren, Mich.

[21] Appl. No.: 727,326

[22] Filed: Sep. 27, 1976

Related U.S. Application Data

[62] Division of Ser. No. 608,486, Aug. 28, 1975, abandoned.

[51] Int. Cl.[2] ..... C25F 3/06; C25F 1/06; C25D 3/12; B32B 13/06

[52] U.S. Cl. ..... 204/34; 204/38 C; 204/129; 204/129.75; 204/129.8; 427/330

[58] Field of Search ..... 204/34, 38 C, 129.75, 204/129.8, 32, 129.95; 252/146

[56] References Cited

U.S. PATENT DOCUMENTS

| | | | |
|---|---|---|---|
| 2,594,124 | 4/1952 | Charlesworth | 204/129.8 |
| 2,639,264 | 5/1953 | Chester | 204/34 |
| 3,107,221 | 10/1963 | Harrison et al. | 252/148 |
| 3,231,507 | 1/1966 | Beale et al. | 252/146 |
| 3,310,497 | 3/1967 | Hudson et al. | 252/146 |
| 3,840,441 | 10/1974 | Mees et al. | 204/34 |
| 3,957,669 | 5/1976 | Tulsi et al. | 252/79.4 |

*Primary Examiner*—F.C. Edmundson

*Attorney, Agent, or Firm*—Arthur E. Kluegel; Richard P. Mueller

[57] ABSTRACT

A novel acidic etching bath composition is disclosed consisting of an acid e.g. sulphuric acid and an unsaturated alcohol e.g. but-2-ene-1,4,-diol, allyl alcohol, propargyl alcohol or but-2-yne-1,4-diol. Etching plating and enamelling procedures are disclosed for producing enamel coatings with improved adhesion to steel substrates.

7 Claims, No Drawings

METAL TREATMENT

This is a division of application Ser. No. 608,486, filed Aug. 28, 1975, now abandoned.

The present invention relates to the coating of metal with protective non metallic films and layers, and particularly to the coating of a steel workpiece with vitreous enamel or an organic or inorganic coating by a process which involves, for example, fusing the layer of applied enamel to the surface of the workpiece by heating.

The workpiece conventionally has its surface prepared for the coating process by chemical etching followed by chemical deposition of a metal precoating layer, e.g. a nickel precoating layer. This is a slow process. I have tried increasing the speed of the process by replacing the chemical deposition be electrolytic deposition of the metal precoating layer, and I have also tried replacing the chemical etching by electrolytic etching.

The etching was carried out in dilute sulphuric acid at about 70° C. I have found that when mild steel is being treated the etching results are inconsistent in that the adhesion of an enamel layer varies from batch to batch of steel (as tested by dropping a standard steel test cylinder having a ball end from a standard height onto the coated workpiece under test.)

I have tried adding a number of organic chemicals to the etching bath to overcome this problem. One of my earlier proposals in German Offenlegungschrift No. 2,409,672.8 was to use sodium benzene sulphinate. This gives excellent etching but I have found that during continuous production use a cathodic reduction occurs resulting in a build-up of mercaptans with their characteristic pervasive and offensive small. This either means that the bath must be changed regularly or that additional expensive fume removal equipment must be installed.

I have thus tried adding a number of other organic compounds to try and achieve good etching whilst avoiding the above problem. I have discovered that the addition of certain mono- and polyfunctional unsaturated alcohols to the electrolytic etching bath is beneficial.

Thus according to the present invention an etching bath suitable for use in the acidic liquid pre-treatment of steel articles, e.g. in electrolytic etching, prior to surface finishing comprises an acid effective to etch a steel article and an organic compound containing an alcoholic hydroxyl group and aliphatic unsaturation. The organic compound may contain acetylenic unsaturation but preferably contains ethylenic unsaturation. Preferred are monoethylenically unsaturated alcohols and polyols, e.g. diols, and preferably those containing one or more hydroxyl groups each attached to a carbon atom which is in $\alpha$ position to the ethylenically unsaturated linkage, i.e. containing a group of formula

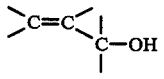

The organic compound may contain a secondary or tertiary alcoholic hydroxyl group but preferably contains a primary alcoholic hydroxyl group. It is preferred that the organic compound contains not more than 10 carbon atoms and preferably not more that 6 carbon atoms. As examples of monoethylenically unsaturated organic compounds we may mention allyl alcohol and but-2-ene-1,4-diol. Examples of acetylenically unsaturated organic compound are propargyl alcohol and but-2-yne-1,4-diol.

The organic compound may be present in concentrations of, for example, from 0.01 to 10 grams per liter, more usually from 0.05 or 0.1 to 5 grams per liter. When using allyl alcohol it is preferred to use from 0.4 to 4 grams per liter in the etching bath, whilst when using but-2-ene-1,4-diol the concentration may range from 0.15 to 2 grams per liter, e.g. from 0.16 to 1.6 grams per liter. When using propargyl alcohol I prefer to use a concentration of 0.05 to 1.0 gpl e.g. 0.05 to 0.5 gpl. When using but-2-yne-1,4-diol I prefer to use a concentraton of 0.02 to 1 grams per liter e.g. 0.10 to 0.5 g.p.l.

The organic compound is preferably water soluble, at least at the reaction temperature at which the etching bath is to be used and at the chosen concentration of organic compound. If desired, a solution assistant such as a wetting agent, may be used to reduce acid spray and to assist wetting of the surface to be etched. The wetting agent, if used, should preferably be an anionic wetting agent and should be chosen so as to be essentially stable under the conditions to be used in the etching bath. As examples of suitable wetting agents we may mention disodium 4-dodecyl-3,3'-disulpho-1,1'-diphenyl ether, perfluorocarbon sulphonic acids and their salts, and sulphonic or sulphuric acid compounds of the general formula $H(CF_2.CF_2)_x—(CH_2)_yZM$ where $x$ is an integer at least equal to 2 and preferably from 2 to 15, $y$ is an integer from 1 to 3, M is a cation and Z is the radical $—SO_3^-$ or $—OSO_3^-$. Preferably sufficient wetting agent is added to the bath to reduce the surface tension of the etching bath to below 45 dynes per centimeter, e.g. at least 0.02 grams per liter of etching bath, preferably 0.05 to 2.0 grams per liter, or more especially 0.1 to 0.40 grams per liter. In general ethoxylated wetting agents should not be used since these are usually liable to be destroyed by heating and under the anodic oxidizing conditions prevailing in an electrolytic etching bath.

The acid in the etching bath is preferably a strong mineral acid such as sulphuric acid, hydrochloric acid, nitric acid or phosphoric acid or a blend of one or more such strong mineral acids. The concentration of acid in the etching bath is preferably at least 1 gram (calculated as anhydrous acid e.g. $H_2SO_4$, HCl or $H_3PO_4$) per liter, e.g. from 20 to 600 grams of anhydrous acid per liter of etching bath.

The etching bath may additionally contain an organic sulphur-containing compound of the formula

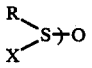

wherein R represents an organic radical joined to the sulphur atom via a carbon atom, and X represents $R_1$ or OM or OH where M is a metal atom and $R_1$ represents an organic radical joined to the sulphur atom via a carbon atom. Typical examples of such compounds, which may also be written as having the formula

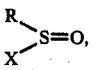

are sodium benzene sulphinate and dimethyl sulphoxide. The etching bath may contain from 0.5 to 10 grams per liter, e.g. 0.7 to 1.5 grams per liter, of such a sulphur containing organic compound.

The invention also extends to an electrolytic etching process in which the workpiece is made the anode and is immersed in a bath in accordance with the invention and d.c. current passed through it using cathodes e.g. of a lead-tin alloy or lead e.g. at a current density of 1 to 100 e.g. 20 to 70 e.g. 40 to 60 amps/sq. foot to remove 0.1 to 10 e.g. 1 to 5 or 2 to 3 grams/sq.foot.

The invention also extends to a plating process comprising a pretreatment stage in which a metal workpiece is contacted with an etching bath in accordance with the invention and a plating stage in which the pretreated workpiece is contacted with a metal plating composition under conditions effective to plate the workpiece with the metal contained in the said metal plating composition e.g. in an amount of at least 40 mg/sq. foot.

The pretreatment preferably comprises an etching process in accordance with the invention and the metal plating composition preferably comprises an electrolytic metal plating composition e.g. an acidic nickel sulphate composition and the workpiece is made the cathode and has a d.c. current passed through it to deposit at least 40 milligrams/sq. ft., e.g. 60 to 120 milligrams/sq. ft. preferably 80 milligrams/sq. ft.

The invention also extends to an enamelling process comprising a pretreatment and plating process in accordance with the present invention, and to steel articles, sheet or strip whenever etched, plated or enamelled by a process in accordance with the invention.

The invention may be put into practice in various ways and some specific embodiments will be described by way of example only.

EXAMPLE 1

Etching process

A mild steel workpiece is submitted to the following sequence of steps.

1. Soak-clean the workpiece in a wetted alkaline cleaner, 50–75 grams/liter, at 70°–95° C. for 6 to 12 minutes.
2. Rinse in warm water at 70° C.
3. Rinse in cold running water.
4. Electrolytically-clean the workpiece, using a wetted alkaline cleaner, 50–75 grams/liter, at 70°–95° C. for 2 to 6 minutes, using a steel or stainless steel cathode at a current density of 25–50 amps/sq. foot.
5. Rinse in cold running water.
6. Etch the workpiece as the anode in 7% weight by volume aqueous sulphuric acid containing 0.8 grams/-liter of but-2-ene-1,4-diol at 70° C., using an insoluble lead-tin alloy cathode at a current density of 5 amps/sq. decimeter, (50 amps/sq foot) for 3 to 6 minutes, to remove 20 to 30 grams/sq meter, 2 to 3 grams/sq. foot.
7. Rinse in cold running water.

Moreover the solution in step 6 can be used continously (subject to maintaining the but-2-ene-1,4-diol concentration) up to relatively high iron contents e.g. of at least 100 grams per liter (at which the solution is normally discarded) whilst still producing a product which after the procedure of Examples 2 and 3 gives a product with satisfactory adhesion of the enamel Periodically the concentration of but-2-ene-1,4-diol is checked and, if its concentration falls below about 0.4 grams per liter, further diol is added to replenish the bath.

When the but-2-ene-1,4-diol is omitted some grades of steel, whilst being etched, do not give adequate adhesion of the enamel coating even when the etch solution is fresh.

Thus by use of the present invention enamelled steel articles with good adhesion of the enamel can be obtained using less expensive mild steel as the base material rather than the costlier grades of steel (enamel steel) usually recommended for enamel coating which have a lower carbon concentration e.g. CR2VE and zero carbon steels.

Enamel steels typically contain not more than 0.05% carbon and zero carbon steels typically contain not more than 0.002% C.

Tests indicate that but-2-ene-1,4-diol used at a concentration of 2 g.p.l., is used up under these conditions at a rate of about 100 milligrams per ampere hour.

Satisfactory enamel adhesion results were still obtained even when the etch bath contained as much as 200 g.p.l. of iron. However, drying on stains are liable to occur when the iron content is above 150 g.p.l. and it is thus preferred to replace the etch bath by fresh material when this level is reached.

EXAMPLE 2

Plating Process

Steps 1 to 7 of Example 1 are repeated and then the following sequence of steps 8 to 13 are carried out.

8. Electrolytic de-smut: to remove carbon and other material in a wetted alkaline solution 50–75 grams/liter, 70°–95° C., as anode at 50 amps/sq. foot for 3 minutes with steel or stainless steel as the cathode.
9. Rinse in cold water.
10. Neutralise by dipping in cold 2% by volume aqueous sulphuric acid for 30 seconds.
11. Rinse in cold water.
12. Nickel-deposition: immerse the workpiece as cathode in an aqueous solution of 80 grams per liter of nickel sulphate ($7H_2O$), 10 grams per liter of ammonium chloride, 20 grams per liter of magnesium sulphate ($7H_2O$), and 5 grams per liter of boric acid, at a pH of 5.3 using nickel anodes at a current density of 2 amps per sq. foot for 2 minutes to produce a deposit of 40 mg/sq. foot.
13. Rinse twice in cold running water.

EXAMPLE 3

Enamelling process

Steps 1 to 13 of Example 2 are repeated and then the following sequence of steps 14 to 18 are carried out.

14. Immerse in hot aqueous sodium nitrite solution (5 grams per liter) at 90° C.
15. Air dry at 60° C.
16. Apply enamel: as an aqueous suspension by dipping or spraying. The enamel has the analysis $SiO_2$ (38.7%), $Al_2O_3$ (7.0%), $B_2O_3$ (22%), fluorine (6%), cobalt oxide (CoO) (0.4%), calcium oxide (0.9%).
17. Dry to leave a coating of the desired thickness (0.002 to 0.005 inches).
18. Heat in air at 800° C. for 4 minutes and then allow to cool in air.

The process produces enamel coated workpieces which have satisfactory adhesion of the enamel when a steel cylinder having a ball end ¾ inch end diameter and weighing 2 lbs. is dropped from a height of 20 inches onto the coated workpiece under test.

It has also been found that the use of a wetting agent, e.g. a fluorinated carbon type wetting agent or the wetting agent of the formula,

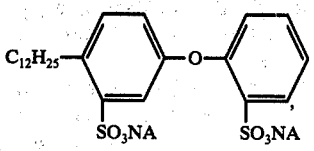

i.e. disodium 4-dodecyl-3,3'-disulpho-1,1'-diphenyl ether, is beneficial to the acidic etch bath.

When used at such a concentration of wetting agent as to reduce the surface tension of the acid etch to below 45 dynes/cm., spraying of the acid during electrolysis is much reduced and etching of low current density areas is improved.

Examples of fluorinated carbon type wetting agents are perfluoro butyl sulphonic acid and homologues up to N-lauryl sulphonic acid, perfluoro cyclohexane sulphonic acid and substituted homologues thereof, perfluoro naphthalene sulphonic acid, and the compounds $H(CF_2.CF_2)_6CH_2SO_3H$ and $H(CF_2.CF_2)7CH_2OSO_3Na$.

EXAMPLE 4

Comparison example

When step 6 of Example 1 is replaced merely by immersion of the workpiece in 7% w/v sulphuric acid at 70° C. for 5 minutes only low weight losses e.g. of 0.3 to 0.7 g/sq meter were observed and the results fluctuated widely with varying grades of mild steel.

When the procedures of Examples 2 and 3 were then carried out on the resulting etched workpiece products with unsatisfactory adhesion of the enamel resulted.

EXAMPLE 5

The procedure of Example 2 was repeated but using instead in step 12 a nickel plating bath of the following composition $NiSO_4.6\frac{1}{2}H_2O$ 70 grams per liter, NaCl 15 grams per liter, $MgSO_4$ 12 grams per liter, and boric acid 7 grams per liter, at a pH of 5.3 to 5.7 at a current density of 2 amps/sq. ft. and at a temperature of 20° C. for 2 minutes.

The procedure of Example 3 was then carried out using the same conventional enamel fired at 800° C. for 4 minutes.

Equally good results were obtained.

EXAMPLE 6

The procedures of Examples 1, 2 and 3 were repeated with a mild steel workpiece which gave bad adhesion results with the process of Example 4. Good adhesion results were obtained.

EXAMPLES 7 and 8

The following etching and plating sequence prior to enamelling is satisfactory for a wide range of mild steels, vitreous enamel steels and zerocarbon steels.

EXAMPLE 7

Etching

1. Soak clean as in step 1 of Example 1 for 6.5 minutes using a proprietary alkaline soak cleaner.
2. Rinse twice in cold water, 0.5 minutes.
3. Immerse in 2% weight by volume $H_2SO_4$ at 60° C. for 2 minutes.
4. Rinse twice in cold water, 0.5 minutes.
5. Electrolytically clean as in Example 1 step 4 at 50 amp/sq. ft. for 2 minutes using proprietary alkaline electrocleaner.
6. Rinse twice in cold water, 0.5 minutes.
7. Etch as in Example 1 step 6 using 0.96 grams per liter of but-2-ene1,4-diol and a mixture of 0.3 grams per liter of potassium salt of perfluoro para ethyl cyclohexyl sulphonic acid and 0.03 grams per liter of potassium salt of perfluoro N-octylsulphonic acid, and 30 seconds immersion followed by 3 minutes immersed electrolytic etching. This removes 2.5 to 2.8 grams/sq. ft. and provides good adhesion. The 30 second immersion before electrolysis starts produces a more uniform etch particularly in low current density areas.
8. Rinse twice in cold water, 0.5 minutes. This completes the etching.

EXAMPLE 8

Plating

9. Electrolytic desmut as in Example 2 step 8.
10. Rinse in cold water for 2 minutes.
11. Neutralize by dipping in 5% weight by volume $H_2SO_4$ at 20° C. for 30 seconds.
12. Rinse in cold water for 0.5 minutes.
13. Nickel plate as in step 12 of Example 2 but at a pH of 5.5 and at room temperature to deposit 60 to 120 mg/sq. foot using a plating bath containing 70 grams per liter $NiSO_4.6\frac{1}{2}H_2O$; 15 grams per liter NaCl; 12 grams per liter $MgSO_4$; 7 grams per liter boric acid.
14. Rinse twice in cold water, 0.5 minutes.
15. Air dry.

This completes the plating step.

The pretreated and plated material may now be enamelled as in Example 3 or by any convention enamelling procedure.

EXAMPLE 9

The etching sequence of Example 7 is repeated using, in place of the fluorinated wetting agents of step 7, 50 mg per liter of disodium 4-dodecyl-3,3'-disulpho-1,1'-diphenyl ether. On plating by the procedure of Example 8 enamel-coated products with satisfactory adhesion of the enamelled coating are obtained. Example 10 illustrates the use of allyl alcohol.

EXAMPLE 10

Steps 1 to 7 of Example 1 are repeated but using in step 6 an etching bath 7% weight by volume aqueous sulphuric acid containing 1.6 grams per liter of allyl alcohol and 50 mg per liter of disodium 4-dodecyl-3,3'-disulpho-1,1'-diphenyl ether.

The procedures of Examples 2 and 3 are then carried out to give results equally as good as obtained in these Examples.

EXAMPLES 11 and 12

The procedure of Example 1 was repeated but using, in place of but-2-ene-1,4-diol, 1.0 grams (Example 11) and 0.2 grams (Example 12) of propargyl alcohol.

The resulting work pieces were etched in both cases the results being in Example 12, a more pitted surface being produced.

EXAMPLE 13

The procedure of Example 1 was repeated but using in place of the but-2-ene-1,4,-diol, 0.15 grams of but-2-yne-1,4,-diol.

Tests indicate that it is used up at 20 milligrams (0.02 grams) per amphere hour.

The etching producing is intermediate in quality between that produced by propargyl alcohol and that produced by but-2-ene-1,4-diol.

EXAMPLE 14

This is an example of an alternative enamelling process to Example 3, using a white enamel which is more difficult to make adhere well than is the cobalt containing enamel of Example 3.

Here the etching time (of Step 7 in Example 7) is extended from 3 minutes to 5 minutes.

The enamelling process is the same as in Example 3 except that the enamel has the following analysis $Sio_2$ (38.3%); $Al_2O_3$ (0.3%); $B_2O_3$ (21.8%); fluorine (2.0%); alkalimetal oxide (15.0%); $TiO_2$ (20.4%); Mg O (0.2%), $P_2O_5$ (3.3%).

Mild steels typically contain a maximum of carbon of about 0.08%, with manganese 0.45% max., sulphur 0.003% max., phosphorous 0.25% max. Mild steel is made using a proportion of scrap and thus traces of other metals such as copper are liable to occur but at varying concentrations from batch to batch of steel.

I claim as our invention and desire to secure by Letters Patent is:

1. An electrolytic etching process for steel which does not result in objectionable formation of mercaptans in which the workpiece is made the anode and is immersed in a composition comprising from 20 to 600 g/l of sulfuric acid, from 0.01 to 10 g/l of an organic compound of up to 10 carbon atoms containing an alcoholic hydroxyl group and having aliphatic unsaturation and a d.c. current is passed through the workpiece using insoluble cathodes at a current density of 1–100 amps per sq. ft. to remove 0.1–10 grams per sq. ft. of metal from the workpiece surface.

2. The process of claim 1 wherein the organic compound is selected from the group consisting of allyl alcohol, propargyl alcohol, 2-butene-1,4 diol and 2-butyne-1,4 diol.

3. The process of claim 2 wherein the sulfuric acid concentration is in the range of from 20 to 200 g/l and the organic compound concentration is in the range of from 0.05 to 5 g/l.

4. The process of claim 3 wherein the composition additionally contains at least one agent selected from the group consisting of fluorocarbon wetting agents, 4-dodecyl-3,3' disulpho-1,1'-diphenyl ether, and their salts, in a concentration of at least 0.02 g/l.

5. The process of claim 1 wherein the insoluble cathode is selected from the group consisting of lead or tin-lead alloy.

6. The process of claim 1 wherein the workpiece is subsequently rendered cathodic in the presence of an aqueous nickel electroplating bath to cause deposition of nickel thereon in an amount of at least 40 mg/ft$^2$.

7. The process of claim 6 wherein the workpiece containing a nickel deposit thereon is subjected to vitreous enameling.

* * * * *